United States Patent [19]

Standish

[11] 4,286,925

[45] Sep. 1, 1981

[54] CONTROL CIRCUIT FOR SHUTTING OFF THE ELECTRICAL POWER TO A LIQUID WELL PUMP

[75] Inventor: Thomas R. Standish, Houston, Tex.

[73] Assignee: Delta-X Corporation, Houston, Tex.

[21] Appl. No.: 89,844

[22] Filed: Oct. 31, 1979

[51] Int. Cl.[3] ..... F04B 49/00

[52] U.S. Cl. ..... 417/12; 417/18; 417/33; 417/63

[58] Field of Search ..... 417/1, 18, 22, 12, 63, 417/33

[56] References Cited

U.S. PATENT DOCUMENTS

| | | | |
|---|---|---|---|
| 2,577,479 | 12/1951 | Owen et al. | 417/1 |
| 3,269,320 | 8/1966 | Tilley et al. | 417/1 X |
| 3,306,210 | 2/1967 | Boyd et al. | 417/1 |
| 3,851,995 | 12/1974 | Mills | 417/18 X |
| 3,953,777 | 4/1976 | McKee | 417/45X |

*Primary Examiner*—Carlton R. Croyle
*Assistant Examiner*—Edward Look
*Attorney, Agent, or Firm*—Fulbright & Jaworski

[57] ABSTRACT

A control circuit for turning off the electrical power to the drive motor, which reciprocates a polished rod of a pump, when the pump has exhausted the supply of liquid in the well. Simultaneously measuring the polished rod load and rod position and turning off the power when the load is greater than or equal to a preset load and the position is equal to a preset position on the downstroke of the well. A first comparator measures the polished rod load relative to a preset load, and a second comparator measures the polished rod position relative to a preset point so that the power is shut off when the load is greater than or equal to the preset load and the position is equal to the preset point on the downstroke. A set of digital latches act to insure that the load is greater than the preset load for two consecutive strokes before the power is shut off. Measuring when the polished rod load is less than a preset load and the polished rod position is equal to a preset point on the upstroke and turning off power to the well and signalling that an abnormal condition exists at the well. Connections are provided for an external plotter so that a plot of load versus position can be plotted to give a visual representation of the well activity.

5 Claims, 7 Drawing Figures

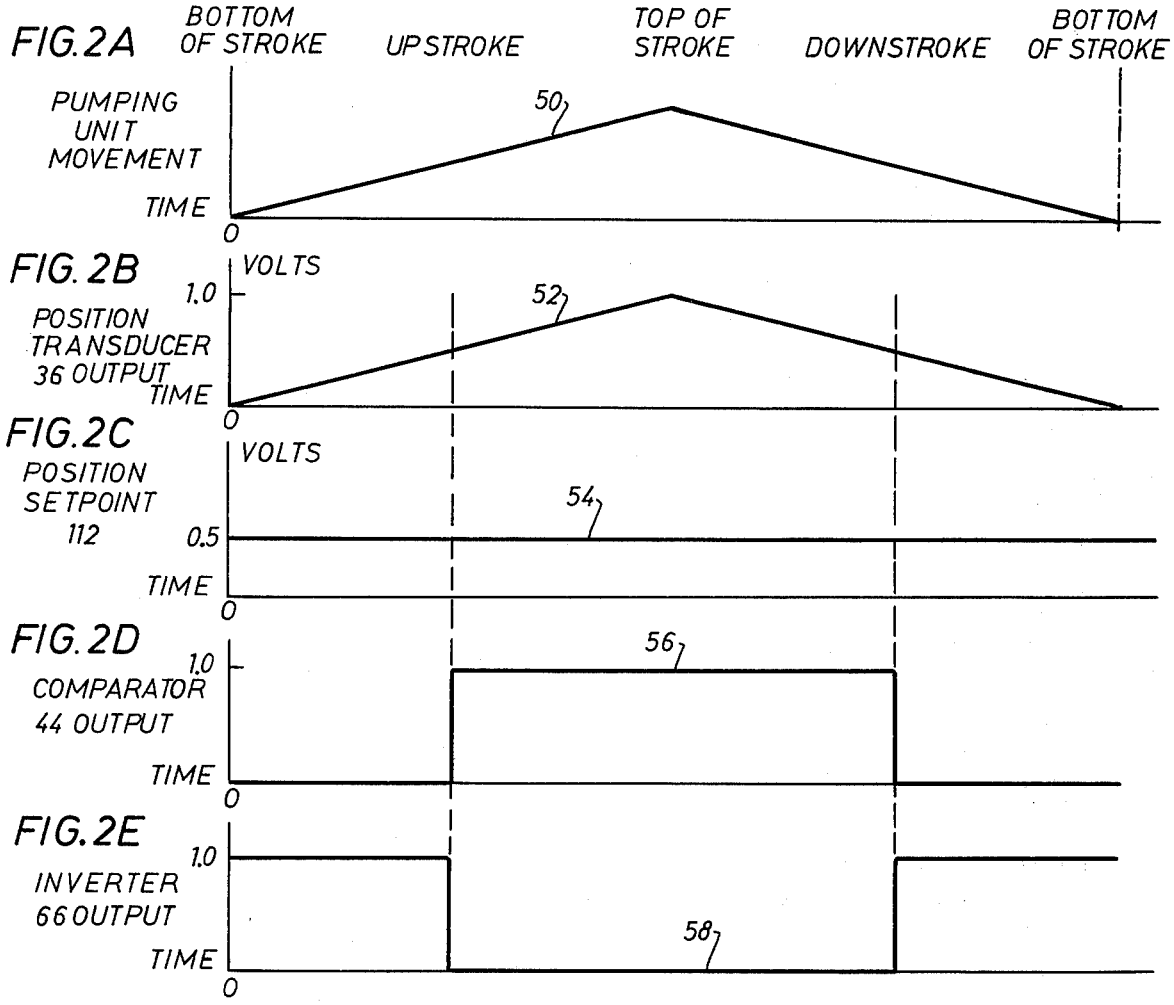
FIG. 2A
BOTTOM OF STROKE
UPSTROKE
TOP OF STROKE
DOWNSTROKE
BOTTOM OF STROKE
PUMPING UNIT MOVEMENT
50
TIME
0
FIG. 2B
VOLTS
1.0
52
POSITION TRANSDUCER 36 OUTPUT
TIME
0
FIG. 2C
VOLTS
POSITION SETPOINT 112
54
0.5
TIME
0
FIG. 2D
1.0
56
COMPARATOR 44 OUTPUT
TIME
0
FIG. 2E
1.0
INVERTER 66 OUTPUT
58
TIME
0
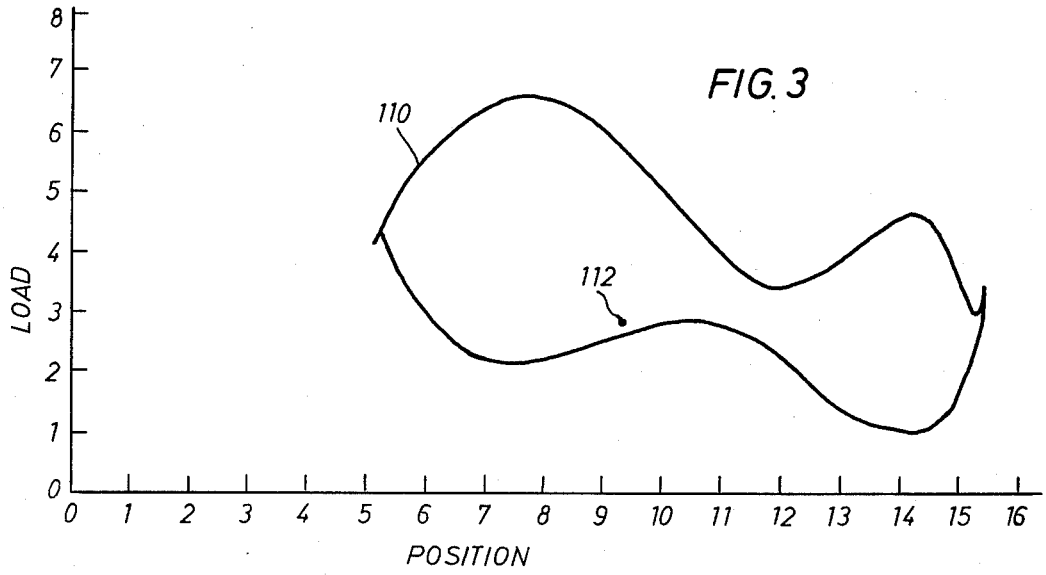
FIG. 3
110
112
LOAD
0
1
2
3
4
5
6
7
8
0 1 2 3 4 5 6 7 8 9 10 11 12 13 14 15 16
POSITION

CONTROL CIRCUIT FOR SHUTTING OFF THE ELECTRICAL POWER TO A LIQUID WELL PUMP

BACKGROUND OF THE INVENTION

Control circuits for shutting off power to a pumping well when the well has been pumped dry have generally relied on either a change in an average measurement, such as the average motor current, average load or average time between load changes, or in a change in the rate of change (slope) of the motor current or load.

The present invention uses the actual load on the polished rod and the actual position of the polished rod to determine if the pump is filling properly and utilizes the fact that as the pump begins to only partially fill, the load on the downstroke of the pump remains large. The invention employs a novel approach by allowing an easy method of setting a point for checking if the pump is filling properly.

Another problem is that should the rods which connect the pump with the surface break in two due to wear, the pumping unit should be shut down and an alarm set. The invention checks for this occurrence on every stroke by comparing the upstroke load against a preset load. If the load is less than the set point and the position is equal to a set point on the upstroke, indicating a lighter load due to the broken rods, the control circuit shuts the pumping unit off and sets a visual alarm to alert the problem. The present invention allows the use of an external plotter which plugs into the control circuitry and allows the operator to obtain a plot of the actual operation of the pump. The external plotter is also used to set the point at which the control circuitry checks the pump fillage and the condition of the rods.

SUMMARY

The present invention utilizes a control circuit which measures the actual load and position of the polished rod and when the load is greater than or equal to a preset load and the position equal to a preset position on the downstroke, the power is turned off. The control circuit uses two comparators, one for load and one for position, as a means for determining when the pumping unit has reached the check point in each cycle.

A further object of the present invention is the use of two digital latches which are so arranged so as to require the pumping unit to repeat the conditions of shut-off for two consecutive cycles to insure that temporary abnormalities such as pump stickage, gas compression or contaminant blockage do not shut the well down prematurely.

Still a further object of the present invention is the utilization of the control circuitry to check for a loss of load during the upstroke portion of the cycle. This is accomplished by checking whether the polished rod load is below a preset load when the position is equal to a preset position on the upstroke portion of the cycle. This checking assures that the rod connecting the pump to the surface has not parted.

Still a further object of the present invention is that the control circuit, upon detecting the breaking in the pump rods as previously described, will shut the pumping unit off until the pumping unit is repaired and the control circuit is manually restarted. Upon detecting broken pumping rods, the control circuit may indicate the malfunction by operating a lamp to give visual indication of the problem.

Still a further object of the present invention is that an external plotter can be connected to the control circuitry to allow both the plotting of the polished rod load versus the polished rod position and the setting of the point for checking when the pump begins to partially fill. The use of the external plotter allows great ease in interpreting the condition of the pump and in allowing the operator to determine if the pump and control circuitry are working properly.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIGS. 2A, 2B, 2C, 2D and 2E are graphs illustrating various electrical outputs relative to the stroke position of the polished rod of the pump, and FIG. 3 is a plot of the position versus the load of the polished rod of the pump for one cycle and an indication of the set point.

DESCRIPTION OF THE PREFERRED EMBODIMENT

Figure 1:
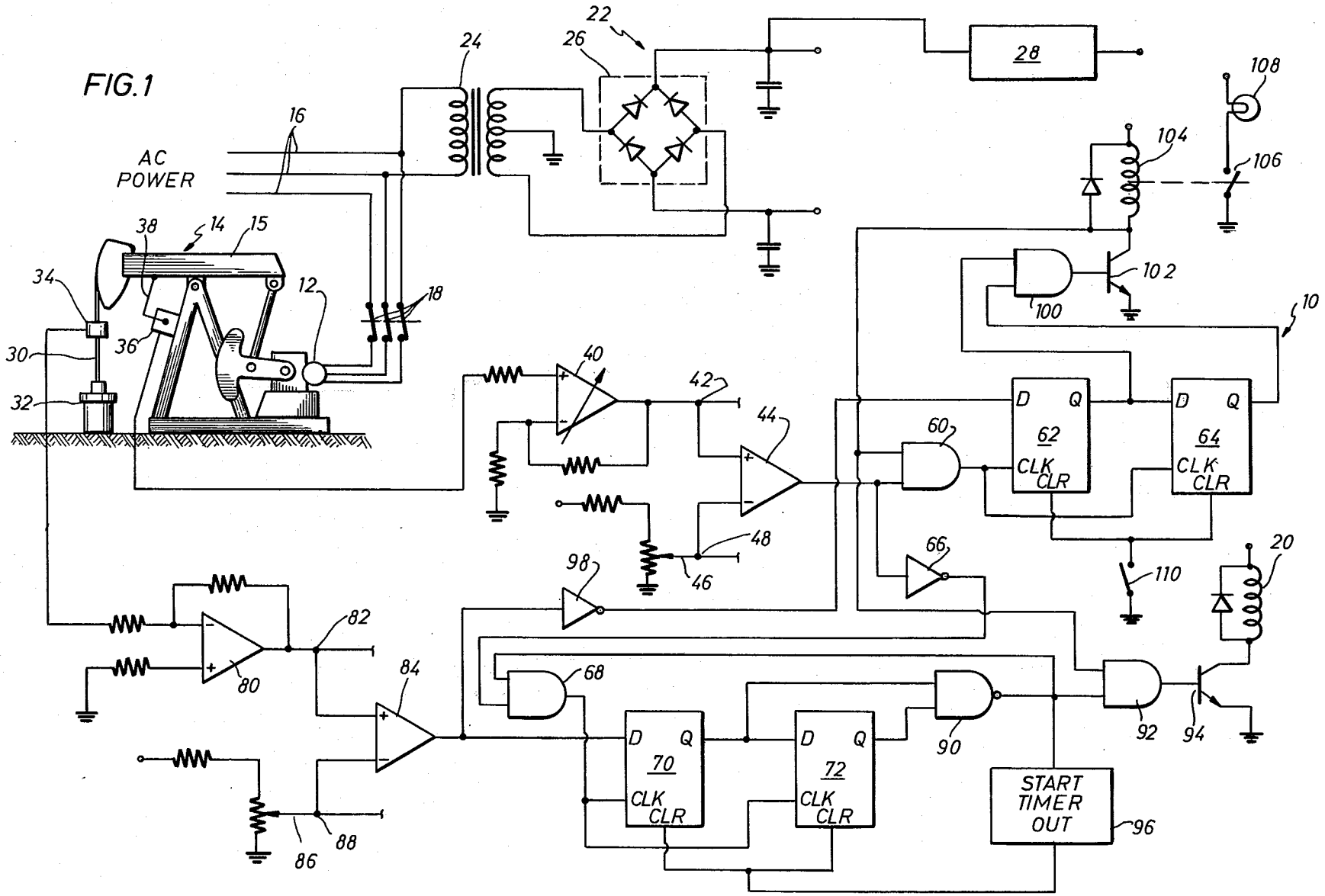
FIG. 1 is an electrical and mechanical schematic of the present invention.

Referring now to the drawings, particularly to FIG. 1, the control circuit for turning off power to a drive motor 12 of a conventional oil well pumping unit 14 is generally indicated by the reference numeral 10. Electrical power supply lines 16 supply power through contacts 18 which are controlled by relay 20 and held normally closed allowing power to drive the motor 12 unless the control circuit 10 operates relay 20 to open the contacts 18 and turn off the electrical power to the motor 12. A suitable power supply generally indicated by the reference numeral 22 provides DC power to the control circuit 10 and may include a transformer 24, rectification means 26 and a voltage regulator 28.

The motor 12 drives the conventional pumping unit 14 including a walking beam 15 which reciprocates a polished rod 30 upwardly and downwardly through a wellhead 32 for actuating a well pump therebelow as is conventional.

Two measuring means or transducers are mounted on the pumping unit 14. A load measuring means or transducer 34, which may be a conventional strain gauge load cell, is connected to the polished rod 30 for providing a DC output signal which is proportional to the load on the polished rod 30. A position measuring means or transducer 36 measures the vertical position of the polished rod 30 and may be a potentiometer having an actuating arm 38 which is connected to the walking beam 15 which provides a voltage output which is proportional to the angle of the walking beam 15 and thus of the vertical position of the polished rod 30.

The signal from the position transducer 36 inputs into the control circuitry 10 into a variable gain amplifier 40. Amplifier 40 is variable to allow the operator to adjust the input angle signal to the appropriate length of stroke which is a function of the length of the walking beam 15 and the angle swept by the movement of the walking beam 15. The signal output from amplifier 40 is made available at terminal 42 to an external plotter where it is used as the X axis input to the plotter as will be described in greater detail later. The output of amplifier 40 also inputs into the positive input of a comparator 44.

The negative input of comparator 44 consist of a variable resistor 46 which is used to set the point at which comparator 44 switches. The voltage level from variable resistor 46 which is input into comparator 44 is also made available at terminal 48 as the X axis input to the external plotter to allow the operator to see where the X axis set point is relative to the position plot as will be described later.

FIG. 2 illustrates various functions including the output of comparator 44 as a function of the movement of the pumping unit 14. FIG. 2A shows a plot 50 of the pumping unit 14 movement versus time for one cycle of the pumping unit. The pumping unit starts each cycle at the bottom of the stroke which is distance zero. The pumping unit moves to the top of the stroke at time equal to one-half cycle and then moves back to the bottom of the stroke at time equal one cycle. FIG. 2B shows the output 52 of the position transducer 36 versus time. The position transducer 36 output at the bottom of the stroke is at a nominally low voltage (shown here as zero volts) and the output of the position transducer 36 gives an increasingly larger voltage output as the pumping unit 14 moves in the upward direction until it reaches a peak voltage (shown here as one volt) at time equal to one-half cycle. The output of position transducer 36 then decreases as pumping unit 14 descends on the downstroke until the voltage from the position transducer 36 returns to the lower voltage level (zero volts) at time equal one cycle. The set point potentiometer 46 maintains a constant voltage shown as plot 54 in FIG. 2C throughout the pumping cycle (shown as 0.5 volts). The comparator 44 receives the position transducer 36 signal into the positive input of the comparator 44 and the set point potentiometer 46 into the negative input of the comparator. The comparator 44 functions to give a low voltage output anytime the positive input voltage is less than the negative input voltage. The comparator 44 gives a positive output voltage when the positive input voltage is greater than the negative input voltage. FIG. 2D shows the output 56 of the comparator 44. The output of comparator 44 is in a low voltage state (shown as zero volts) as long as the position transducer output 36 is less than the set point voltage (shown as 0.5 volts). The comparator 44 output continues to be low as the cycle continues until the time is equal to the one-quarter cycle at which time the position transducer output 36 equals the set point resistor 46 voltage and the comparator 44 switches from a low voltage to a high voltage (shown as switching from zero volts to one volt). The comparator 44 output stays at a high level until time is equal to the three-quarters cycle at which time the position transducer 36 output becomes less than the set point potentiometer voltage 46 and the comparator 44 switches from a high voltage to a low voltage output. The result of the comparator 44 is a square wave with a period equal to the time it takes the pumping unit 14 to complete one full cycle.

As shown in FIG. 1, the square wave output of comparator 44 is input to an AND gate 60 and the output of AND gate 60 is input into the clock portion of the D type latches 62 and 64. A D type latch holds as output whatever data is present at the D input on the rising edge of the clock.

Thus the latches 62 and 64 record any data that is present on the rising edge of the output of comparator 44 which occurs during the upstroke portion of the pumping cycle. The output of comparator 44 is also input into an inverter 66 which causes the clock cycle to be the inverse of the comparator output as shown on FIG. 2E of the timing diagram 58. The output of inverter 66 is passed through AND gate 68 and is input to the clock of the D type latches 70 and 72. The result of the output of inverter 66 causes the data present on the D input of latches 70 and 72 to be recorded on the rising edge of the clock input which occurs on the downstroke portion of each pumping cycle.

The output of load transducer 34 is input to the control circuitry 10 into amplifier 80. The signal from amplifier 80 is made available at terminal 82 to an external plotter where it is used as the Y axis input to the plotter. The output of amplifier 80 is also input into the positive input of comparator 84. The negative input of comparator 84 consist of a variable resistor 86 which is used to set the point at which the comparator 84 switches. The voltage level from variable resistor 86 which is input to comparator 86 is also made available at terminal 88 to an external plotter as the Y axis set point so that the set point can be visually set in relation to the Y axis load plot.

The output of comparator 84 switches to a high level voltage when the signal from the load transducer 34 is greater than the set point voltage from the variable resistor 86. The output of comparator 84 switches to a low level voltage when the signal from the load transducer 34 is less than the set point voltage from resistor 86. The output of comparator 84 is the input to the D input of the D type latch 70. In a normal pumping cycle when the pump is filling properly, the output of comparator 84 is a logic one (high voltage output) on the upstroke portion of the pumping cycle and a logic zero (low output voltage) on the downstroke portion of the pumping cycle. As previously discussed, the clock input to latch 70 occurs on the downstroke portion of the pumping cycle so that during normal operation, a logic zero is clocked into latch 70. The output of latch 70 is the input into NAND gate 90 which causes the output of NAND gate 90 to be a logic one. The output of NAND gate 90 is passed through AND gate 92 and on the base of transistor 94 which allows transistor 94 to conduct which energizes relay 20, the contacts 18 of which close, to allow the pumping unit motor 12 to run.

As the pumping unit 14 begins remove all of the available fluid from the well, the voltage output from transducer 34 will remain at a high voltage during the downstroke portion of the pumping cycle. This high voltage will be greater than the voltage output from the set point potentiometer 86 (having been previously set by the operator) and when this condition exists at the point in stroke equal to the set point resistor 46, the latch 70 will have a logic one present at its input during the rising edge of the clock and the output of latch 70 will become a logic one. The output of NAND gate 90 remains at a logic one because the output of latch 72 is at a logic zero. If during the downstroke portion of the next pumping cycle, the output from the load transducer 34 is again greater than the set point potentiometer 86 voltage then both latches 70 and 72 will clock to a logic one which sets the output of the NAND gate 90 at a logic zero which will pass through AND gate 92 and cause transistor 94 to stop conducting and de-energize relay 20 which shuts off the voltage to the pumping unit motor 12. Thus the logic requires two consecutive occurrences of the load being greater than the set point on the downstroke portion of the pumping cycle in order to shut the power off to the pumping unit 14.

The output of the NAND gate 90 is also input to a conventional timer 96 and when the signal from NAND gate 90 goes to a logic zero indicating that the pump has removed all of the available fluid, the timer 96 starts timing for a preset amount of time. When the preset time expires, the output of timer 96 goes to a logic one which is input to the reset input of latches 70 and 72 which resets the latches 70 and 72 to a logic zero level and forces NAND gate 90 to a logic one which passes through AND gate 92 and allows transistor 94 to conduct which energizes relay 20, closes contacts 18, and allows voltage to be applied to the pumping unit motor 12.

An abnormal condition, indicating that the pumping unit has malfunctioned, exists when the load transducer 34 voltage is less than the set point potentiometer 86 voltage on the upstroke portion of the pumping cycle. This condition exists when the rods 30 which connect the downhole pump to the surface pumping unit break and the surface pumping unit 14 is doing no useful work. During this condition, the output of comparator 84 will be in a zero state and the output of inverter 98 will be a logic one. The output of inverter 98 is input into the D type latch 62. As previously discussed, the input to the clock portion of latch 62 is from comparator 44 and the clocking action occurs on the upstroke of each pumping unit cycle. Under normal pumping conditions, the output of inverter 98 is a logic zero which clocks a logic zero into the output of latch 62 on the rising edge of the clock input. A logic zero on one input of AND gate 100 outputs a logic zero which places a low voltage at the base of transistor 102 which causes transistor 102 to not conduct, keeping a relay coil 104 de-energized. When a malfunction condition exists, the output of inverter 98 is placed at a logic one during the upstroke portion of the pumping cycle which places a logic one on the D input of latch 62. On the rising edge of the clock signal from AND gate 60, the logic one is clocked into the latch 62 and a logic one appears at the output of the latch 62. The output of AND gate 100 remains at a logic zero because the output of latch 64 is at a logic zero so that the system continues to operate. If on the next upstroke of the pumping unit 14 the output of inverter 98 remains at a logic one, a logic one will be present at the input of latch 62 and will also be present at the input of latch 64 since the previous clock caused the output of latch 62 to be a logic one. The rise of the next clock from AND gate 60 will clock a logic one into both latches 62 and 64 which will cause a logic one to appear on both inputs of AND gate 100 which allows the output of AND gate 100 to go to a logic one. When the output of AND gate 100 goes to a logic one the base of transistor 102 becomes forward biased and allows transistor 102 to conduct which causes relay coil 104 to energize and close its contact 106 and light the malfunction indicator 108. When transistor 102 is allowed to conduct the collector of transistor 102 is switched from a high voltage to a voltage near ground. The signal from collector of transistor 102 is input to one side of AND gate 92. When transistor 102 switches to a low voltage a low voltage (logic zero) is placed on the input to AND gate 92 which causes the output of AND gate 92 to go to a logic zero which causes transistor 94 to stop conducting and de-energize relay 20 which opens contacts 18 and shuts off the flow of electrical power to the pumping unit motor 12. Thus the occurrences of malfunction on two consecutive upstrokes of the pumping unit 14 will cause the control circuitry 10 to turn on the malfunction light 108 and shut off the electrical power to the pumping unit 14. The pumping unit 14 will remain in the shutoff state following a malfunction until push button 110 is depressed which causes the output of both latches 62 and 64 to be reset to a logic zero and allows the system to restart.

As has been previously indicated, an X-Y plotter such as a DXI-30 plotter sold by Delta-X may be connected to the control circuit 10 to monitor the operation. The X-Y plotter may be connected to the position terminal 42 and the load terminal 82, respectively. A full pump graph 110, as best seen in FIG. 3, may be drawn on the plotter. After the graph 110 is drawn, a determination is made of the location of point such as 112 at which the unit should be shut off. The X-Y plotter is then connected to the terminals 48 and 88 to adjust the resistors 46 and 86, respectively, to provide the set point 112. That is, the pump-off point 112 is set by adjusting potentiometers 46 and 86 wherein potentiometer 46 adjusts the X axis and potentiometer 86 adjusts the Y axis and potentiometers 46 and 86 are adjusted so that the pen of the plotter will rest at the point 112 at which it is desired that the unit will shut down on pumpoff. The graph 110 shows the load versus position of the polished rod 30 for a full pump. However, if the load-position line changes relative to the set point 112, the unit will be shut down, that is, when the load on the downstroke is equal to or greater than the set point 112. The same set point 112 is also used by the control circuit 10 to check for malfunction or parting of the polished rod 30. A malfunction occurs when the load on the upstroke is less than the set point 112 for two consecutive strokes. The upstroke load being less than the set point 112 indicates that the pump is lifting only the weight of some of the rods and the upstroke load will be less than the preset load value.

The operation of the control circuit 10 is based on comparing the signals from the load transducer 34 and the position transducer 36 relative to the signals from the set point potentiometers 86 and 46, respectively. The circuit 10 first monitors the position transducer 36 to determine if the unit is on the upstroke or downstroke. It then determines when the stroke is at the same position as the set point. On the upstroke at the time the stroke crosses the set point, the circuit 10 checks whether the load signal from transducer 34 is greater than the set point set by potentiometer 86. If the signal is not greater than the set point, the circuit 10 sets a memory latch and on the next stroke it checks the load value again and if it is low a second time, the circuit 10 shuts off the pump unit 14 as a malfunction. If the load is not less than the set point on the second stroke, the memory is reset and the circuit 10 begins checking again. Thus, the circuit 10 requires two consecutive strokes with a low load to set the malfunction relay 104 and indicator 108.

On the downstroke, when the stroke is equal to the set point 112, the controller checks to see whether the load is less than the set point value. As long as the load is lower than the set point 112 load value, the pump is filling. Once the downstroke equals the set point 112, the circuit 10 sets a memory latch and waits for the next downstroke to check a second time. If the load is equal to the set point 112 on the second stroke, the unit is shut off for the down time. The downstroke load check requires that the load be equal or greater than the set point for two consecutive strokes in order to keep occasional gas pounds from shutting the unit down prematurely.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A control circuit for shutting off the electrical power to the drive motor which reciprocates the polished rod of a liquid well pump comprising, strain gauge load measuring means connected to the polished rod measuring the load in the polished rod, position measuring means for measuring the position of the polished rod in the well, a first electrical comparator connected to the load measuring means measuring the polished rod load relative to a preset load point, a second electrical comparator connected to the positioned measuring means measuring the polished rod position relative to a preset position, variable electrical inputs connected to said first and second comparators for varying the preset load and preset position, terminal connections on the inputs of the comparators for attaching an external plotter for comparing the preset load and preset position inputs to the measured load and measured position inputs, and switching means controlling the power to the motor and connected to the outputs of said first and second comparators for shutting off the power when the load is greater than the preset load, and the position is equal to the preset position on the downstroke.

2. The apparatus of claim 1 including counting means connected to said switching means counting that the load is greater than the preset load for at least two consecutive pump strokes before the switching means is shut off.

3. The apparatus of claim 1 including, means for sensing that the polished rod load is less than a predetermined load and the polished rod position is at a predetermined location on the upstroke and turning off power to the motor.

4. A control circuit for shutting off the electrical power to the drive motor which reciprocates the polished rod of a liquid well pump comprising, load measuring means connected to the polished rod measuring the load in the polished rod, position measuring means for measuring the position of the polished rod in the well, a first comparator connected to the load measuring means measuring the polished rod load relative to a preset load point, a second comparator connected to the positioned measuring means measuring the polished rod position relative to a preset position, switching means controlling the power to the motor and connected to the outputs of said first and second comparators for shutting off the power when the load is greater than the preset load, and the position is equal to the preset position on the downstroke, said switching means comprises, an inverter connected to the output of the second comparator, an AND gate connected to the output of the inverter, a two-stage D type latch having clock input connected to the output of the AND gate, the D input of the D type latch connected to the output of the first comparator, a NAND gate connected to the outputs of the D type latch, a second AND gate connected to the output of the NAND gate, a power switch connected to and controlled by the second AND gate and in turn controlling the power to the motor.

5. A control circuit for shutting off the electrical power to the drive motor which reciprocates the polished rod of a liquid well pump comprising, load measuring means connected to the polished rod measuring the load in the polished rod, position measuring means for measuring the position of the polished rod in the well, a first comparator connected to the load measuring means measuring the polished rod load relative to a preset load point, a second comparator connected to the positioned measuring means measuring the polished rod position relative to a preset position, switching means controlling the power to the motor and connected to the outputs of said first and second comparators for shutting off the power when the load is greater than the preset load, and the position is equal to the preset position on the downstroke, an inverter connected to the output of the first comparator, a two-stage D type latch having its input connected to the output of the inverter, an AND gate connected to the output of the second comparator, and the output of the AND gate connected to the clock inputs of the D latch, a second AND gate connected to the outputs of the D latch, a power switch controlling the power to the motor connected to the output of the second AND gate.

* * * * *